US009202411B2

(12) United States Patent
Jung et al.

(10) Patent No.: US 9,202,411 B2
(45) Date of Patent: Dec. 1, 2015

(54) ORGANIC LIGHT EMITTING DISPLAY DEVICE AND METHOD OF DRIVING THE SAME

(71) Applicant: LG Display Co., Ltd., Seoul (KR)

(72) Inventors: Jae Hoon Jung, Gyeonggi-do (KR); Jae Hwan Yun, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 44 days.

(21) Appl. No.: 14/134,111

(22) Filed: Dec. 19, 2013

(65) Prior Publication Data

US 2014/0176622 A1 Jun. 26, 2014

(30) Foreign Application Priority Data

Dec. 26, 2012 (KR) ..... 10-2012-0153718

(51) Int. Cl.
*G09G 3/32* (2006.01)

(52) U.S. Cl.
CPC ..... *G09G 3/3208* (2013.01)

(58) Field of Classification Search
CPC ..... G09G 2300/0842; G09G 2320/0295; G09G 2320/043; G09G 2320/045; G09G 3/3208; G09G 3/3233; G09G 3/3291; H03K 17/30; H03M 1/1023; H03M 1/123; H03M 1/1295; H03M 1/56
See application file for complete search history.

(56) References Cited

U.S. PATENT DOCUMENTS

2005/0029453 A1* 2/2005 Allen et al. ..... 250/332
2008/0315788 A1 12/2008 Levey et al.
2009/0295422 A1 12/2009 Hammer et al.
2010/0225634 A1 9/2010 Levey et al.
2010/0245331 A1 9/2010 Shirouzu et al.
2010/0281320 A1* 11/2010 Dunipace ..... 714/736
2011/0007067 A1* 1/2011 Ryu et al. ..... 345/214
2011/0074762 A1 3/2011 Shirasaki et al.
2011/0227505 A1 9/2011 Park et al.

FOREIGN PATENT DOCUMENTS

CN 101689349 A 3/2010
CN 102034429 A 4/2011
CN 102047313 A 5/2011

(Continued)

OTHER PUBLICATIONS

Chinese Office Action issued in Chinese Patent Application No. 201310713441.1 on Sep. 28, 2015.

*Primary Examiner* — Gerald Johnson
(74) *Attorney, Agent, or Firm* — Morgan, Lewis & Bockius LLP

(57) ABSTRACT

Disclosed is an organic light emitting display device. The organic light emitting display device includes a display panel including a plurality of pixels formed in intersection areas between a plurality of gate lines, a plurality of data lines, and a plurality of sensing lines, a gate driver supplying a gate signal to the gate lines, a plurality of data driving ICs including a data driver, supplying data voltages to the data lines, and a sensing unit including a plurality of ADCs that each sense characteristic change of a driving transistor included in a corresponding pixel to generate sensing data, a memory storing a gain error and offset error of each ADC, and a timing controller correcting the sensing data on a basis of the gain error and offset error, modulating input data on a basis of the corrected sensing data, and supplying the modulated data to the data driving ICs.

10 Claims, 10 Drawing Sheets

(56) References Cited

FOREIGN PATENT DOCUMENTS

| | | | |
|---|---|---|---|
| JP | 2010-113153 | A | 5/2010 |
| JP | 2012-519881 | A | 8/2012 |
| JP | 2012-190023 | A | 10/2012 |
| KR | 2010-0047505 | A | 5/2010 |
| KR | 2011-0066506 | A | 6/2011 |
| KR | 10-1073226 | B | 10/2011 |
| WO | 2008/091329 | A1 | 7/2008 |

* cited by examiner

ORGANIC LIGHT EMITTING DISPLAY DEVICE AND METHOD OF DRIVING THE SAME

CROSS-REFERENCE TO RELATED APPLICATIONS

This application claims the benefit of the Korean Patent Application No. 10-2012-0153718 filed on Dec. 26, 2012, which is hereby incorporated by reference as if fully set forth herein.

BACKGROUND

1. Field of the Invention

The present invention relates to an organic light emitting display device, and more particularly, to an organic light emitting display device and a method of driving the same, which compensate for a characteristic change of a driving transistor to enhance a luminance uniformity of an image.

2. Discussion of the Related Art

Recently, with the advancement of multimedia, the importance of flat panel display (FPD) devices is increasing. Therefore, various FPD devices such as liquid crystal display (LCD) devices, plasma display panel (PDP) devices, and organic light emitting display devices are being commercialized.

In such FPD devices, the organic light emitting display devices display an image by using an organic light emitting element that emits light by a recombination of an electron and a hole. The organic light emitting display devices have a fast response time and have no limitation in a viewing angle because self-emitting light, and thus are attracting much attention as next generation FPD devices.

One pixel of a general organic light emitting display device includes a pixel circuit that includes an organic light emitting element and a driving transistor that drives the organic light emitting element. However, in the general organic light emitting display device, threshold voltages/mobility characteristics of driving transistors of a plurality of pixels differ due to a driving time and a non-uniformity of a manufacturing process of a thin film transistor (TFT), and thus, despite the same data voltage being applied to the pixels, amounts of current flowing in the driving transistors of the pixels differ. A current deviation between the driving transistors of the pixels causes a luminance deviation between the pixels, causing a reduction in uniformity of an image quality. As methods for solving such problems, Korean Patent Publication No. 10-2010-0047505 (hereinafter referred to as patent document 1), Korean Patent Publication No. 10-2011-0066506 (hereinafter referred to as patent document 2), and Korean Patent Registration No. 10-1073226 (hereinafter referred to as patent document 3) are disclosed.

In the reference documents, a sensing transistor and a sensing line are formed in each pixel. An analog-to-converter (ADC) of a sensing unit included in a data driver (i.e., a data driving integrated circuit (IC)) senses a voltage charged into the sensing line according to driving of the driving transistor, and a characteristic change of the driving transistor is compensated for by correcting data according to the sensed voltage, thereby preventing a quality of an image from being degraded due to a luminance deviation between the pixels.

However, the ADC generally has a gain error and an offset error, and a deviation of output data output from the ADC occurs due to a process differential between a plurality of the data driving ICs in a manufacturing process of the data driving ICs. In addition, a deviation between the ADCs of the data driving ICs also occurs.

The gain error denotes an error in which an actual digital output deviates by a certain rate from an ideal digital output with respect to an analog input, and in detail, the gain error is an error that occurs when an accurate value at the center of an analog input range approaches the minimum value and maximum value of the analog input range.

The offset error denotes an error in which an actual digital output deviates by a certain amount from an ideal digital output with respect to an analog input, and in detail, the offset error denotes a high or low degree of a measurement value which is obtained when measuring a signal known to a user.

FIG. 1 is a waveform diagram showing output data with respect to an input voltage of an analog-to-digital converter (ADC). FIG. 2 is a waveform diagram for describing an output deviation between a plurality of data driving ICs in a general organic light emitting display device.

In FIG. 1, a graph A is a graph that shows ideal output data with respect to an input voltage, and a graph B is a graph that shows actual output data with respect to the input voltage.

As seen in FIG. 1, even when the same input voltage is applied to the ADC, a deviation of output data of the ADC occurs. That is, as shown in the graph A, ideal output data of the ADC with no gain error and offset error is determined by a multiplication (x) of an input voltage (x) and an ideal gain error (a). However, the ADC generally has the gain error and the offset error, and thus, as shown in the graph B, actual output data of the ADC is determined by the sum of a value (x×a'), which is obtained by multiplying the input voltage (x) and an actual gain error (b), and the actual offset error (i.e., an output with respect to an input voltage of 0).

As seen in FIG. 2, it can be seen that an output deviation between a plurality of the ADCs occurs even between a plurality of data driving ICs (D-IC #1 to #8).

Therefore, the reference documents correct data on the basis of sensing data which are distorted due to a deviation of the sensing data of the ADCs, and thus cannot more accurately compensate for the characteristic changes of the driving transistors.

As a result, it is required to minimize an output deviation between the ADCs that respectively sense the characteristic changes of the driving transistors.

SUMMARY

Accordingly, the present invention is directed to provide an organic light emitting display device and a method of driving the same that substantially obviate one or more problems due to limitations and disadvantages of the related art.

An aspect of the present invention is directed to provide an organic light emitting display device and a method of driving the same, which can minimize an output deviation between a plurality of analog-to-digital converters.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided an organic light emitting display device including: a display panel configured to include a plurality of pixels that are respectively formed in a plurality of intersection areas between a plurality of gate lines, a plurality of data lines, and a plurality of sensing lines; a gate driver configured to supply a gate signal to the plurality of gate lines; a plurality of data driving ICs configured to include a data driver, which respectively supplies data voltages to the plurality of data lines, and a sensing unit including a plurality of analog-to-digital converters (ADCs) that each sense a characteristic change of a driving transistor, included in a corresponding pixel, through a corresponding sensing line to generate sensing data; a memory configured to store a gain error and an offset error of each of the plurality of ADCs; and a timing controller configured to correct the sensing data on a basis of the gain error and the offset error, modulate input data on a basis of the corrected sensing data, and supply the modulated data to the plurality of data driving ICs.

The timing controller may subtract the offset error from the sensing data, and divide the subtracted result value by the gain error to calculate the corrected sensing data.

The timing controller may separately drive the sensing unit in a precharging period and a sensing period during an ADC deviation correction mode. During the precharging period, the sensing unit may supply a test voltage to the plurality of sensing lines, and during the sensing period, the sensing unit may supply measurement data, output from each of the plurality of ADCs, to the timing controller.

The timing controller may incrementally increase a voltage level of the test voltage, obtain measurement data, based on the voltage level, output from each of the ADCs to supply the obtained measurement data to an external error correction apparatus, and store the gain error and the offset error, which are supplied from the error correction apparatus, in the memory.

The sensing unit may sense the characteristic change of the driving transistor, included in each of a plurality of pixels of a selected horizontal line, through a corresponding sensing line during a display period, and supply the sensing data corresponding to the characteristic change to the timing controller, and the timing controller may correct the sensing data on a basis of the gain error and the offset error, and modulate input data, which are to be respectively supplied to the pixels of the horizontal line, on a basis of the corrected sensing data.

In another aspect of the present invention, there is provided a method of driving an organic light emitting display device, including: a display panel configured to include a plurality of pixels that are respectively formed in a plurality of intersection areas between a plurality of gate lines, a plurality of data lines, and a plurality of sensing lines; and a plurality of data driving ICs including a built-in sensing unit that includes a plurality of analog-to-digital converters (ADCs) selectively connected to the plurality of sensing lines, including: (A) calculating a gain error and an offset error of each of the plurality of ADCs on a basis of output data of each ADC based on a test voltage supplied to the plurality of sensing lines; (B) sensing a characteristic change of a driving transistor, included in each of the plurality of pixels, through a corresponding ADC to generate sensing data of each pixel; (C) correcting the sensing data on a basis of the gain error and the offset error; and (D) modulating input data on a basis of the corrected sensing data to supply the modulated data to the plurality of data driving ICs.

Step (C) may include subtracting the offset error from the sensing data, and dividing the subtracted result value by the gain error to calculate the corrected sensing data.

Step (A) may include: (A1) supplying a gate signal having a gate-off voltage level to the plurality of gate lines; (A2) supplying the test voltage to the plurality of sensing lines, and sensing, by a corresponding ADC, a voltage of each of the plurality of sensing lines with the test voltage supplied thereto; (A3) obtaining measurement data, based on the data voltage, output from each of the ADCs; and (A4) calculating a gain error and an offset error of each ADC by using a least square method based on the measurement data to store the gain error and the offset error in a memory.

Step (A2) may include incrementally increasing a voltage level of the test voltage, and sensing, by the corresponding ADC, the voltage of each of the plurality of sensing lines with the incrementally increased test voltage supplied thereto, and step (A4) may include calculating the gain error and the offset error in each section of the test voltage.

Step (A4) may include calculating the same gain error and offset error of the plurality of ADCs, and step (C) may include applying the same gain error and offset error to the sensing data of the plurality of ADCs.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, an organic light emitting display device and a method of driving the same according to embodiments of the present invention will be described in detail with reference to the accompanying drawings.

Figure 1:
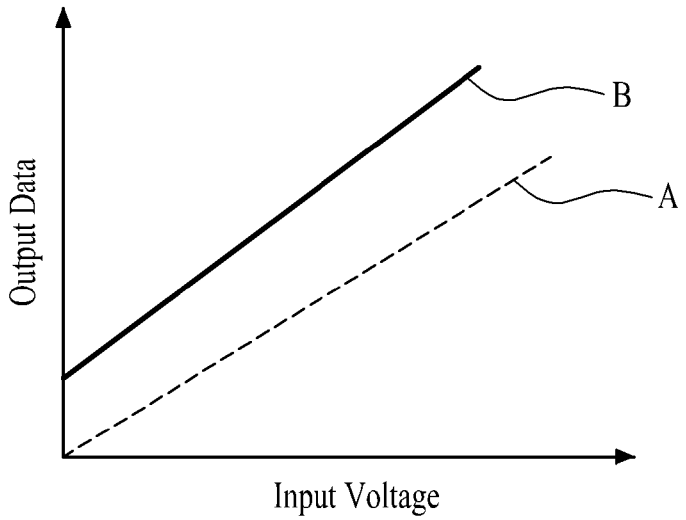
FIG. 1 Related Art
FIG. 1 is a waveform diagram showing output data with respect to an input voltage of an analog-to-digital converter (ADC)
Figure 2:
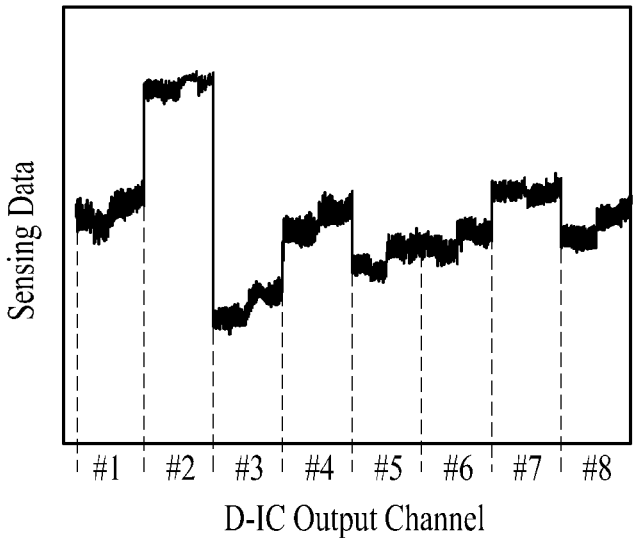
FIG. 2 Related Art
FIG. 2 is a waveform diagram for describing an output deviation between a plurality of data driving ICs in a general organic light emitting display device.
Figure 3:
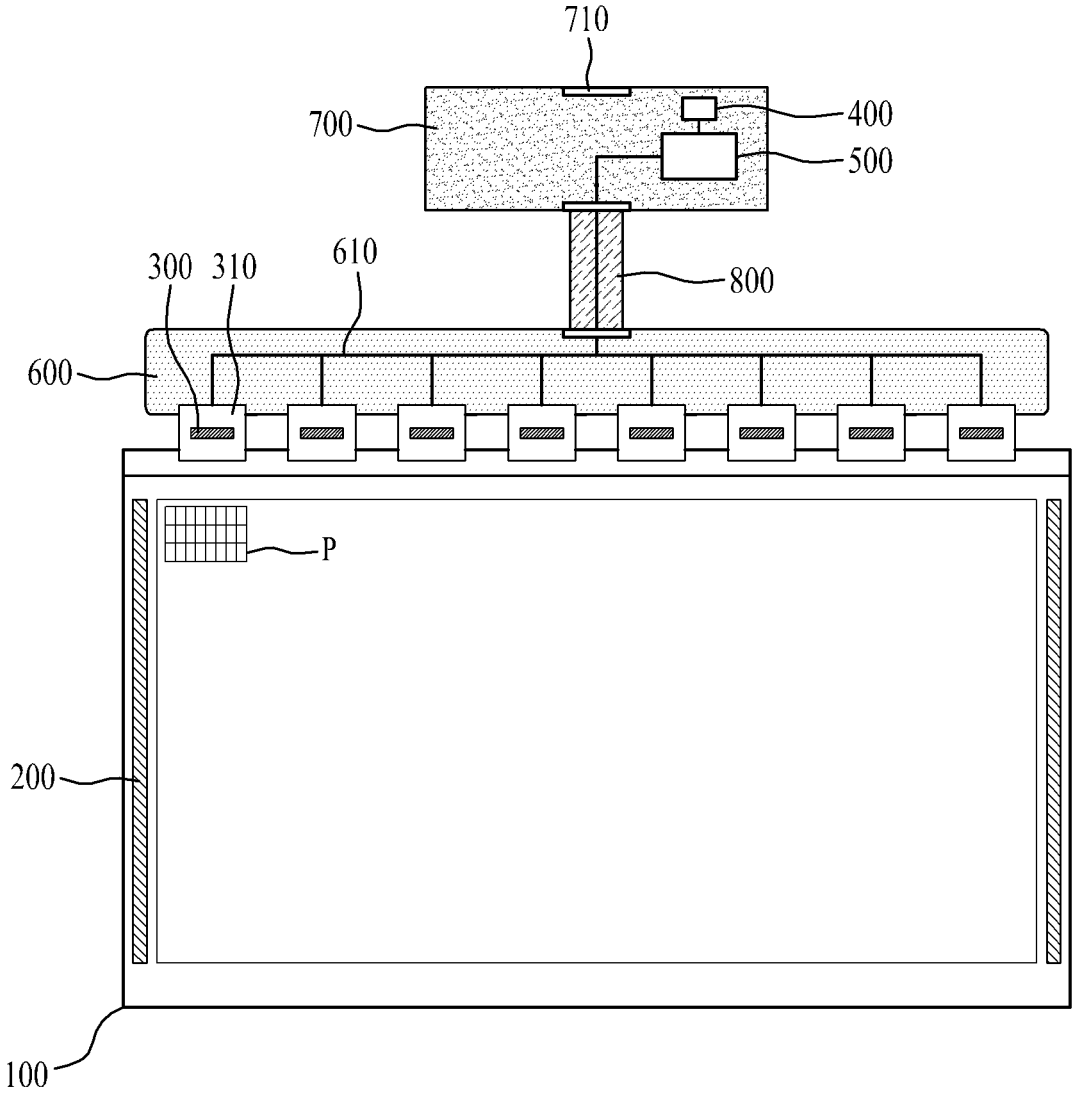
FIG. 3 is a diagram for describing an organic light emitting display device according to an embodiment of the present invention.
Figure 4:
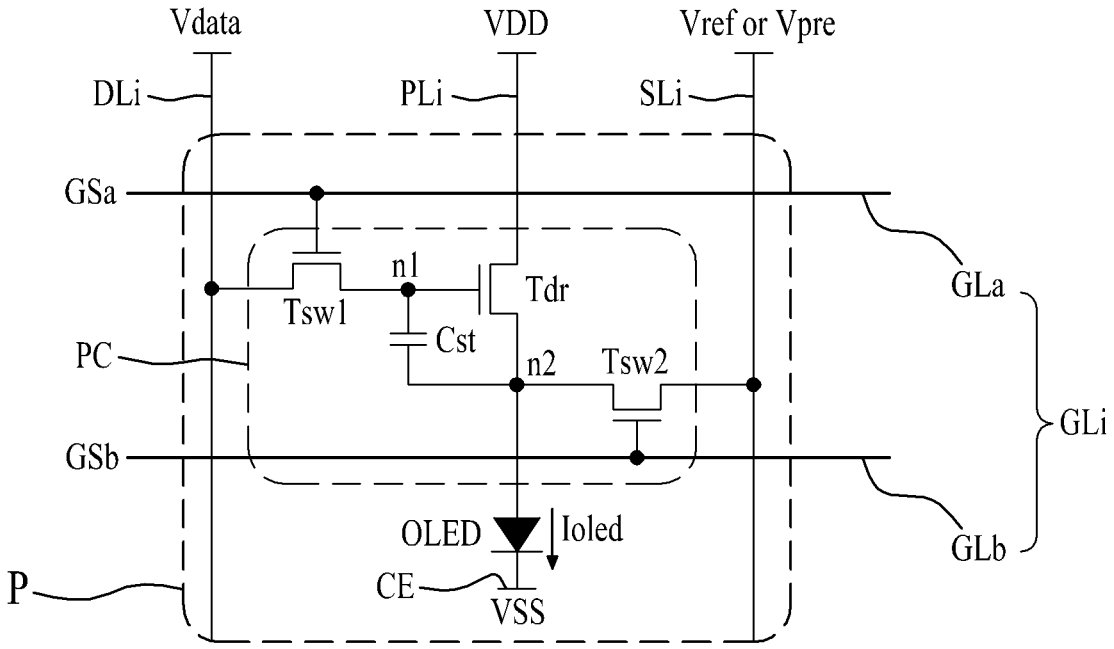
FIG. 4 is a diagram illustrating a structure of one pixel illustrated in FIG. 3.
Figure 5:
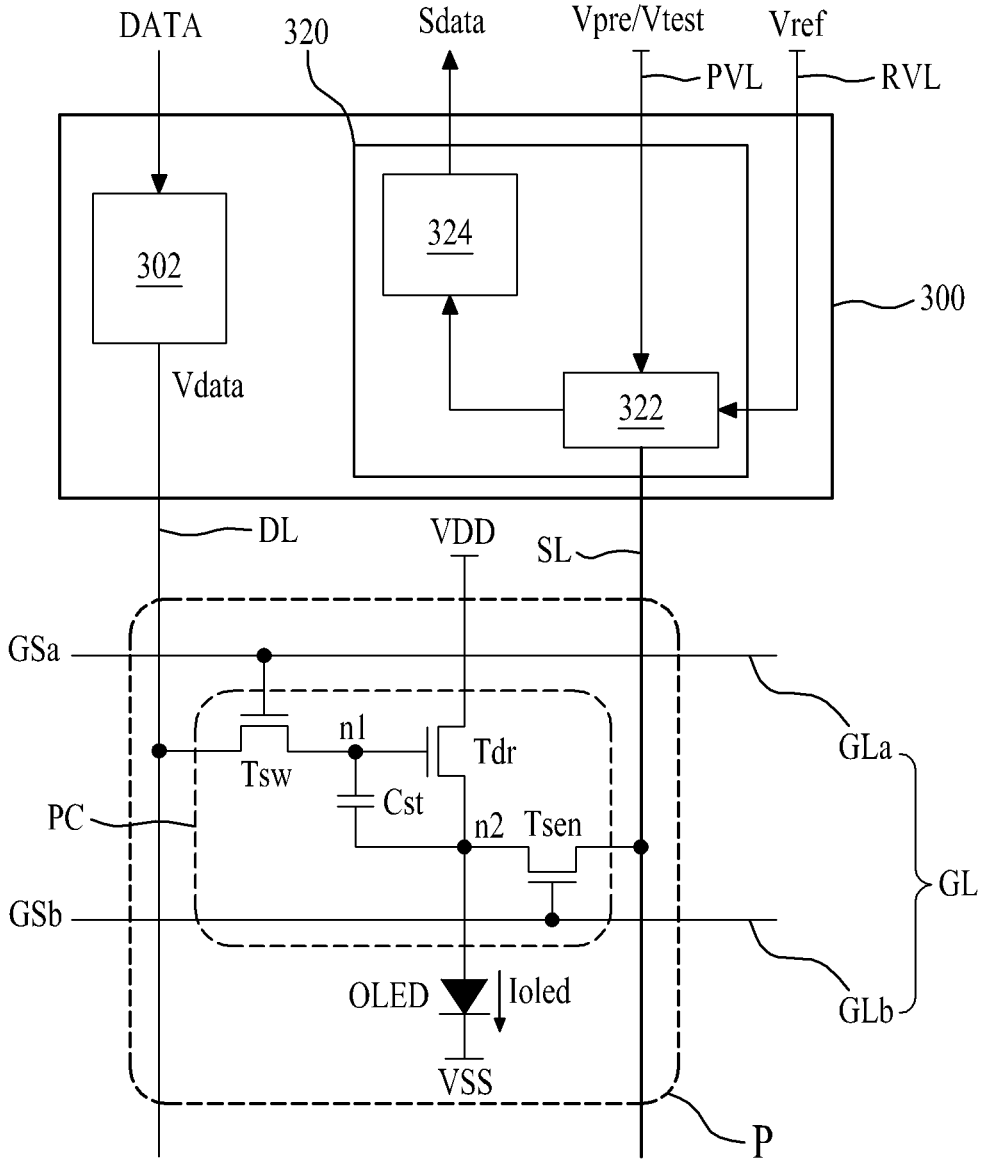
FIG. 5 is a diagram for describing a data driving IC of FIG. 3.

FIG. 3 is a diagram for describing an organic light emitting display device according to an embodiment of the present invention. FIG. 4 is a diagram illustrating a structure of one pixel illustrated in FIG. 3. FIG. 5 is a diagram for describing a data driving IC of FIG. 3.

Referring to FIGS. 3 to 5, the organic light emitting display device according to an embodiment of the present invention includes a display panel 100, a gate driver 200, a plurality of data driving ICs 300, a memory 400, and a timing controller 500.

The display panel 100 includes a plurality of pixels P. The plurality of pixels P are respectively formed in a plurality of pixel areas defined by intersections between a plurality of gate line groups GL, a plurality of data lines DLi, and a plurality of sensing lines SLi parallel to the plurality of data lines DLi.

The plurality of gate line groups GLi are formed in parallel in a first direction (for example, a horizontal direction) of the display panel 100. Each of the plurality of gate line groups GLi includes adjacent first and second gate lines GLa and GLb. First and second gate signals GSa and GSb are respectively supplied from the gate driver 200 to the first and second gate lines GLa and GLb of each gate line group GLi.

The plurality of data lines DLi are formed in parallel in a second direction (for example, a vertical direction) of the display panel 100 to intersect the plurality of gate line groups GLi. A data voltage Vdata is supplied from the data driving IC 300 to a corresponding data line DLi. The data voltage Vdata, in which a threshold voltage and a mobility of a driving transistor included in a corresponding pixel P have been compensated for, is supplied to the corresponding data line DLi.

The plurality of sensing lines SLi are formed in parallel with the plurality of data lines DLi. A reference voltage Vref or a precharging voltage Vpre is selectively supplied from the data driving IC 300 to each of the plurality of sensing lines SLi. That is, the reference voltage Vref is selectively supplied to each sensing line SLi in a display mode, and the precharging voltage Vpre is selectively supplied to each sensing line SLi in a sensing mode. A test voltage is supplied to each sensing line SLi in a mode (hereinafter referred to as an ADC deviation correction mode) of correcting a deviation between a plurality of analog-to-digital converters (ADCs).

A plurality of driving voltage lines PLi formed in parallel with the plurality of data lines DLi are formed in the display panel 100. A voltage supply unit (not shown) supplies a driving voltage VDD to the plurality of driving voltage lines PLi.

Each of the plurality of pixels P includes an organic light emitting element OLED and a pixel circuit PC.

The organic light emitting element OLED emits light in proportion to a data current Ioled that flows from the driving voltage line PLi to a cathode voltage VSS line according to driving of the pixel circuit PC. To this end, organic light emitting element OLED includes an anode electrode (not shown), an organic layer (not shown) formed on the anode electrode, and a cathode electrode CE formed on the organic layer. Here, the organic layer may be formed to have a structure of a hole transport layer/organic emission layer/electron transport layer or a structure of a hole injection layer/hole transport layer/organic emission layer/electron transport layer/electron injection layer. Further, the organic layer may further include a function layer for enhancing the emission efficiency and/or service life of the organic emission layer. The cathode electrode CE may be separately formed in each of the plurality of pixels P, or may be formed in common in the plurality of pixels P.

The pixel circuit PC may include a first switching transistor Tsw1, a second switching transistor Tsw2, a driving transistor Tdr, and a capacitor Cst. Here, each of the transistors Tsw1, Tsw2 and Tdr is an N-type thin film transistor (TFT), and for example, may be an a-Si TFT, a poly-Si TFT, an oxide TFT, or an organic TFT.

The first switching transistor tsw1 includes a gate electrode connected to a first gate line GLa of the gate line group GLi, a first electrode connected to an adjacent data line DLi, and a second electrode connected to a first node n1 that is a gate electrode of the driving transistor Tdr. The first switching transistor tsw1 supplies the data voltage Vdata, which is supplied to the data line DLi, to the first node n1 (i.e., the gate electrode of the driving transistor Tdr) according to a first gate signal GSa having a gate-on voltage level which is supplied to the first gate line GLa.

The second switching transistor tsw2 includes a gate electrode connected to a second gate line GLb of the gate line group GLi, a first electrode connected to an adjacent sensing line SLi, and a second electrode connected to a second node n2 that is a source electrode of the driving transistor Tdr. The second switching transistor tsw2 supplies the reference voltage Vref (or the precharging voltage Vpre), which is supplied to the sensing line SLi, to the second node n2 (i.e., the source electrode of the driving transistor Tdr) according to a second gate signal GSb having a gate-on voltage level which is supplied to the second gate line GLb.

The capacitor Cst includes the gate electrode and source electrode of the driving transistor Tdr, namely, the first and second nodes connected between the first and second nodes n1 and n2. The capacitor Cst is charged with a difference voltage between voltages respectively supplied to the first and second nodes n1 and n2, and turns on the driving transistor Tdr with the charged voltage.

The driving transistor Tdr includes: a gate electrode that is connected to the second electrode of the first switching transistor Tsw1 and the first electrode of the capacitor Cst in common; a source electrode that is connected, in common, to the first electrode of the second switching transistor Tsw2, the second electrode of the capacitor Cst, and the organic light emitting element OLED; and a drain electrode which that is connected to a corresponding driving voltage line PLi. The driving transistor Tdr is turned on with the voltage of the capacitor Cst, and controls an amount of current that flows from the driving voltage line PLi to the organic light emitting element OLED.

The pixel circuit PC operates in a data charging period and an emission period according to a gate signal supplied from the gate driver 200. That is, the pixel circuit PC charges the capacitor Cst with a difference voltage "Vdata-Vref" between the data voltage Vdata and the reference voltage Vref during the data charging period. During the emission period, the pixel circuit PC turns on the driving transistor Tdr according to the voltage stored in the capacitor Cst, and emits light from the organic light emitting element OLED with the data current Ioled that is determined based on the difference voltage "Vdata-Vref" between the data voltage Vdata and the reference voltage Vref.

In the above-described embodiment, it has been described above that the pixel circuit PC includes three transistors and one capacitor, but the numbers of transistors and capacitors configuring the pixel circuit PC may be variously modified.

The gate driver 200 is provided in a non-display area(s) of one side and/or both sides of the display panel 100, and is connected to the gate lines GL. In this case, the gate driver 200 may be directly provided on a substrate of the display panel 100 along with a process of forming the transistors of each pixel P, and may be connected to one side or both sides of each of the gate lines GL.

The gate driver 200 generates the first and second gate signals GSa and GSb having the gate-on voltage level at every horizontal period according to control by the timing controller 500, and sequentially supplies the first and second gate signals GSa and GSb to the gate line group GLi. At this time, the first and second gate signals GSa and GSb have the gate-on voltage level during the data charging period of each pixel P, and have a gate-off voltage level during the emission period of each pixel P.

Moreover, the gate driver 200 generates the first and second gate signals GSa and GSb for driving a plurality of pixels P of a selected horizontal line in an initialization period, a voltage charging period, and a voltage sensing period, during a sensing period that is set in some horizontal periods of one frame period according to control by the timing controller 500, and supplies the first and second gate signals GSa and GSb to a corresponding gate line group GLi. At this time, the first gate signal GSa has the gate-on voltage level during only the initialization period and the data charging period, and the second gate signal GSb has the gate-on voltage level during only the sensing period.

The gate driver 200 may be provided as an IC type, and mounted on the non-display area(s) of one side and/or both sides of the display panel 100. Alternatively, the gate driver 200 may be provided as the IC type, and mounted on a gate flexible circuit film (not shown). The gate flexible circuit film is adhered to the display panel 100 by a film adhering process.

Each of the plurality of data driving ICs 300 is connected to the data lines DL and the sensing lines SL. Each data driving IC 300 supplies a data voltage and the reference voltage to each pixel P according to control by the timing controller 500, senses a threshold voltage change and a mobility characteristic change of the driving transistor Tdr included in each pixel P of a horizontal line selected from among a plurality of the horizontal lines by using the sensing lines to generate threshold voltage sensing data and mobility sensing data of the driving transistor Tdr, and supplies the threshold voltage sensing data and the mobility sensing data to the timing controller 500. The plurality of data driving ICs 300 are respectively mounted on a plurality of data flexible circuit films 310. One side of each of the plurality of data flexible circuit films 310 is adhered to a data pad portion provided at the display panel 100, and the other side is adhered to a data printed circuit board (PCB) 600 by the film adhering process.

Each data driving IC 300 includes a data driver 302 and a sensing unit 320.

The data driver 302 receives pixel data DATA of each pixel P from the timing controller 500 at every one horizontal line, converts a pixel data DATA into the data voltage Vdata, and supplies the data voltage Vdata to a corresponding data line DLi. During the sensing period, the data driver 302 converts data DATA for sensing supplied from the timing controller 500, and supplies a data voltage Vdata for sensing to the data line DLi. As a result, the data driver 302 supplies the data voltage Vdata to the data line DLi during the data charging period of each horizontal period, and during the initialization period or the initialization period and voltage charging period of the sensing period, the data driver 302 supplies the data voltage Vdata for sensing to the data line DLi. To this end, the data driver 302 includes: a shift register that generates a sampling signal on the basis of a data start signal and a data shift signal which are supplied from the timing controller 500; a latch that latches pixel data DATA according to the sampling signal; a grayscale voltage generator that generates a plurality of grayscale voltages by using a plurality of reference gamma voltages; a digital-to-analog converter (DAC) that selects and outputs, as a data voltage Vdata, a grayscale voltage corresponding to the latched data among the plurality of grayscale voltages; and an output unit that outputs the data voltage Vdata to a corresponding data line DLi according to the data output signal.

In FIG. 5, the data driver 302 is illustrated as being connected to one data line DLi, but are connected to a plurality of data lines equal to the number of predetermined channels.

The sensing unit 320 is connected to the sensing line SLi of each pixel P, and includes a switching unit 322 and an analog-to-digital converter (ADC) 324.

The switching unit 322 selectively connects a reference voltage supply line RVL through which the reference voltage Vref is supplied, a precharging voltage supply line PVL through which the precharging voltage Vpre is supplied, and the ADC 324 to the sensing line SLi according to control by the timing controller 500. That is, the switching unit 322 connects the reference voltage supply line RVL to the sensing line SLi during each horizontal period. On the other hand, the switching unit 322 connects the precharging voltage supply line PVL to the sensing line SLi during the initialization period of the sensing period, and during the data charging period of the sensing period, the switching unit 322 floats the sensing line SLi. During the voltage sensing period of the sensing period, the switching unit 322 connects the sensing line SLi to the ADC 324.

The reference voltage Vref may be one of grayscale voltages output from the grayscale voltage generator of the data driver 302, in which case the reference voltage supply line RVL is connected to the grayscale voltage generator. Here, the reference voltage Vref may have a voltage level of 0, or have a voltage level lower than that of a voltage that turns on the organic light emitting element OLED.

Moreover, the precharging voltage Vpre may also be one of the grayscale voltages output from the grayscale voltage generator, in which case the precharging voltage supply line PVL is connected to the grayscale voltage generator.

When the ADC 324 is connected to the sensing line SLi according to switching of the switching unit 322, the ADC 324 senses a voltage charged into the sensing line SLi, performs digital conversion of the sensed voltage to generate sensing data Sdata, and supplies the generated sensing data Sdata to the timing controller 500. Here, the sensing data Sdata is supplied to the timing controller 500, mounted on a control board 700, through a sensing data transfer line 610 formed at a PCB 600 and a signal transfer member 800.

The memory 400 is mounted on the control board 700, and stores a gain error and an offset error of each of a plurality of the ADCs 324 included in the sensing unit 320. The gain error and offset error of each ADC 324 are calculated by a correction operation based on measurement data output from a corresponding ADC 324 in the ADC deviation correction mode which is performed in a final test process before releasing a finished product of the organic light display device, and is stored in the memory 400. The correction operation may separately calculate the gain error and offset error of each of the plurality of ADCs 324 respectively built into the plurality of data driving ICs 300, calculate the gain error and offset error of each ADC 324 in units of data driving IC 300, or calculate the same gain error and offset error of all the ADCs 324. The ADC deviation correction mode and the correction operation will be described below.

The memory 400 may be built into the timing controller 500.

The timing controller 500 is mounted on the control board 700, and receives a timing sync signal and video data from an external system body (not shown) or a graphics card through a user connector 710.

The timing controller 500 controls a driving timing of each of the gate driver 200 and the plurality of data driving ICs 300 on the basis of the timing sync signal including a vertical sync signal, a horizontal sync signal, a data enable signal, and a clock signal.

The timing controller 500 controls the driving timing of the gate driver 200 so that a plurality of pixels P connected to a corresponding gate line GLi are driven during the data charging period and the emission period in units of one horizontal period, and controls the driving timing of each data driving IC 300 so that during the data charging period, a data voltage Vdata is supplied to a corresponding data line DLi, and the reference voltage Vref is supplied to the sensing line SLi.

The timing controller 500 controls driving of the gate driver 200 so that a plurality of pixels P of one horizontal line selected during the sensing period are driven during the initialization period, the data charging period, and the voltage sensing period, and controls driving of each data driving IC 300 so that a data voltage Vdata for sensing is supplied to a corresponding data line DLi during the initial period or the initialization period and the voltage charging period. Here, a method that senses a threshold voltage change and a mobility characteristic change of the driving transistor Tdr included in each pixel P of one horizontal line selected during the sensing period is disclosed in reference documents 1 to 3, and thus, its detailed description is not provided.

The timing controller 500 corrects sensing data Sdata, which is supplied from the sensing unit 320 of each data driving IC 300 and corresponds to the threshold voltage change and mobility characteristic change of the driving transistor Tdr included in each pixel P, to calculate the corrected sensing data, and stores the corrected sensing data of each pixel P in a separate memory (not shown). The timing controller 500 may correct the sensing data Sdata according to the gain error and the offset error as expressed in Equation (1):

$$y = \frac{(x - b)}{a} \tag{1}$$

where y denotes the corrected sensing data, x denotes the sensing data Sdata, a denotes the gain error of the ADC, and b denotes the offset error of the ADC. The corrected sensing data "y" has a value that is obtained by compensating for an error of measurement data corresponding to an input voltage of the ADC 324.

When input data is input from the outside, the timing controller 500 modulates input data of a corresponding pixel P according to corrected sensing data of the corresponding pixel P which is stored in the memory, and supplies the modulated data to the plurality of data driving ICs 300. Therefore, the timing controller 500 reflects the threshold voltage change and mobility characteristic change of the driving transistor Tdr in the input data on the basis of the corrected sensing data to generate modulation data.

The timing controller 500 operates the gate driver 200 and the plurality of data driving ICs 300 in the ADC deviation correction mode according to a measurement sync signal supplied from the outside.

In detail, in the ADC deviation correction mode, the timing controller 500 controls driving of the gate driver 200 so that the gate signal GS having the gate-off voltage level is supplied to all the gate line groups GLi. Then, the timing controller 500 drives the sensing unit 320, built into each of the plurality of data driving ICs 300, in a precharging period and the sensing period. Subsequently, the timing controller 500 outputs measurement data, output from the ADC 324 of the sensing unit 320 during the sensing period, to an external error correction. In addition, the timing controller 500 stores a gain error and an offset error of each ADC 324 which are supplied from the error correction apparatus, a gain error and an offset error for each data driving IC 300, and the same gain error and offset error of all the ADCs 324 in the memory 400.

In the ADC deviation correction mode, the sensing unit 320 supplies a test voltage Vtest to the plurality of sensing lines SLi during the precharging period, and during the sensing period, the sensing unit 320 supplies the measurement data, output from the ADC 324, to the timing controller 500. At this time, the timing controller 500 may increase the test voltage Vtest, supplied to the plurality of sensing lines SLi during the precharging period, in units of a plurality of periods.

The organic light emitting display device according to an embodiment of the present invention corrects sensing data corresponding to the threshold voltage and mobility characteristic of the driving transistor Tdr included in each of a plurality of pixels of a selected horizontal line on the basis of the gain error and offset error of the ADC 324 of the sensing unit 320 which are stored in the memory 400, and modulates input data according to the corrected sensing data, thereby minimizing distortion of sensing data caused by an output deviation between the ADCs 324 and more accurately compensating for a characteristic change of the driving transistor included in each pixel.

Figure 6:
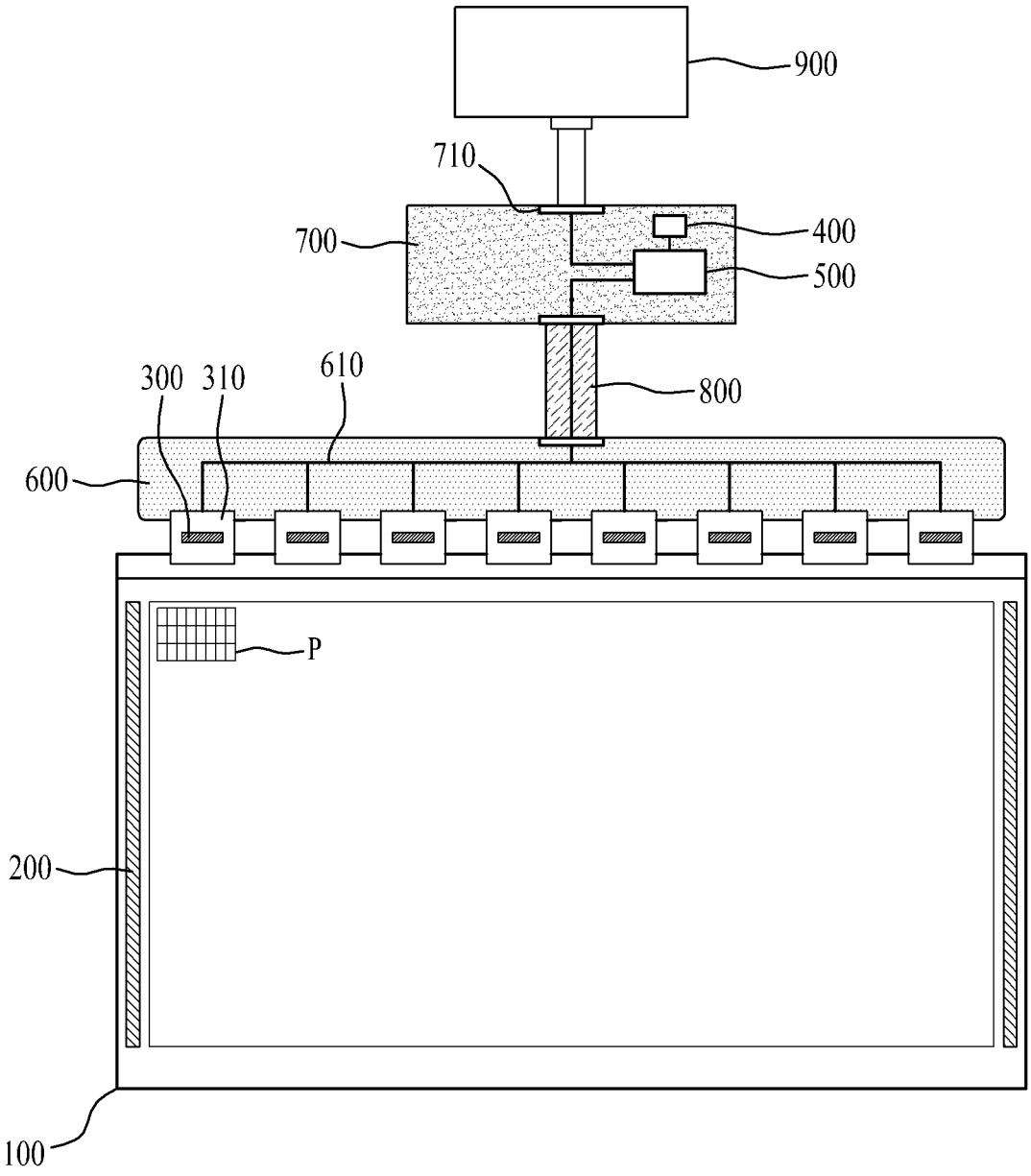
FIG. 6 is a diagram for describing an error correction apparatus for an ADC according to an embodiment of the present invention.
Figure 7:
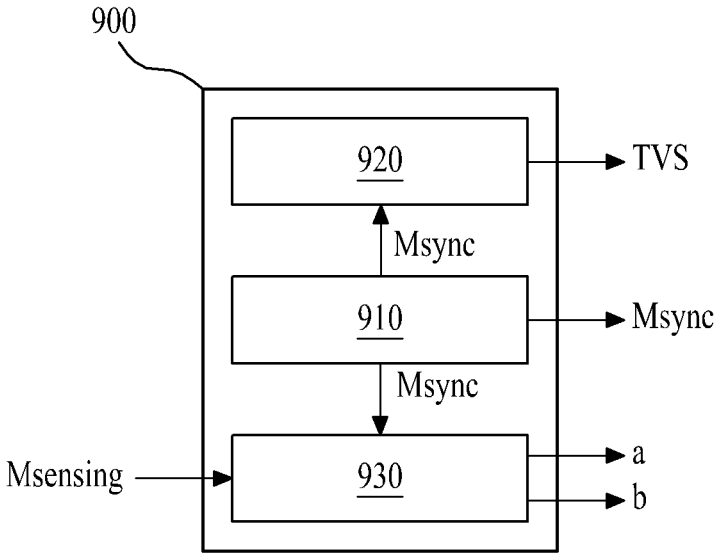
FIG. 7 is a diagram for describing a configuration of the error correction apparatus of FIG. 6.

FIG. 6 is a diagram for describing an error correction apparatus 900 for the ADC according to an embodiment of the present invention. FIG. 7 is a diagram for describing a configuration of the error correction apparatus 900 of FIG. 6.

Referring to FIGS. 6 and 7, the error correction apparatus 900 according to the present invention performs the ADC deviation correction mode while communicating with the timing controller 500 through the user connector 710 mounted on the control board 700 of the organic light emitting display device. To this end, the error correction apparatus 900 includes a measurement sync signal generator 910, a test voltage setter 920, and an error calculator 930.

The measurement sync signal generator 910 generates a measurement sync signal Msync for the ADC deviation correction mode, and supplies the measurement sync signal Msync to the timing controller 500. Therefore, the timing controller 500 sets a driving mode of the display panel 100 to the ADC deviation correction mode according to the measurement sync signal Msync, and operates the gate driver 200 and the plurality of data driving ICs 300 in the ADC deviation correction mode.

The test voltage setter 920 generates a voltage setting signal TVS, used to set a value of the test voltage Vtest to be supplied to a corresponding sensing line SLi, on the basis of the measurement sync signal Msync, and supplies the voltage setting signal TVS to the timing controller 500. Therefore, the timing controller 500 controls the voltage supply unit so that the test voltage Vtest corresponding to the voltage setting signal TVS is supplied to the sensing line SLi, or controls an output voltage of the reference voltage generator.

The error calculator 930 analyzes the measurement data Msensing supplied from the timing controller 500 in units of the data driving IC 300 to calculate the gain error "a" and offset error "b" of the ADC 324. In this case, the error calculator 930 may calculate the gain error "a" and the offset error "b" by using a least square method based on the measurement data Msensing.

The error calculator 930 supplies the calculated gain error "a" and the offset error "b" to the timing controller 500. Therefore, the timing controller 500 stores the gain error "a" and the offset error "b", which are supplied from the error calculator 930, in the memory 400.

Figure 8:
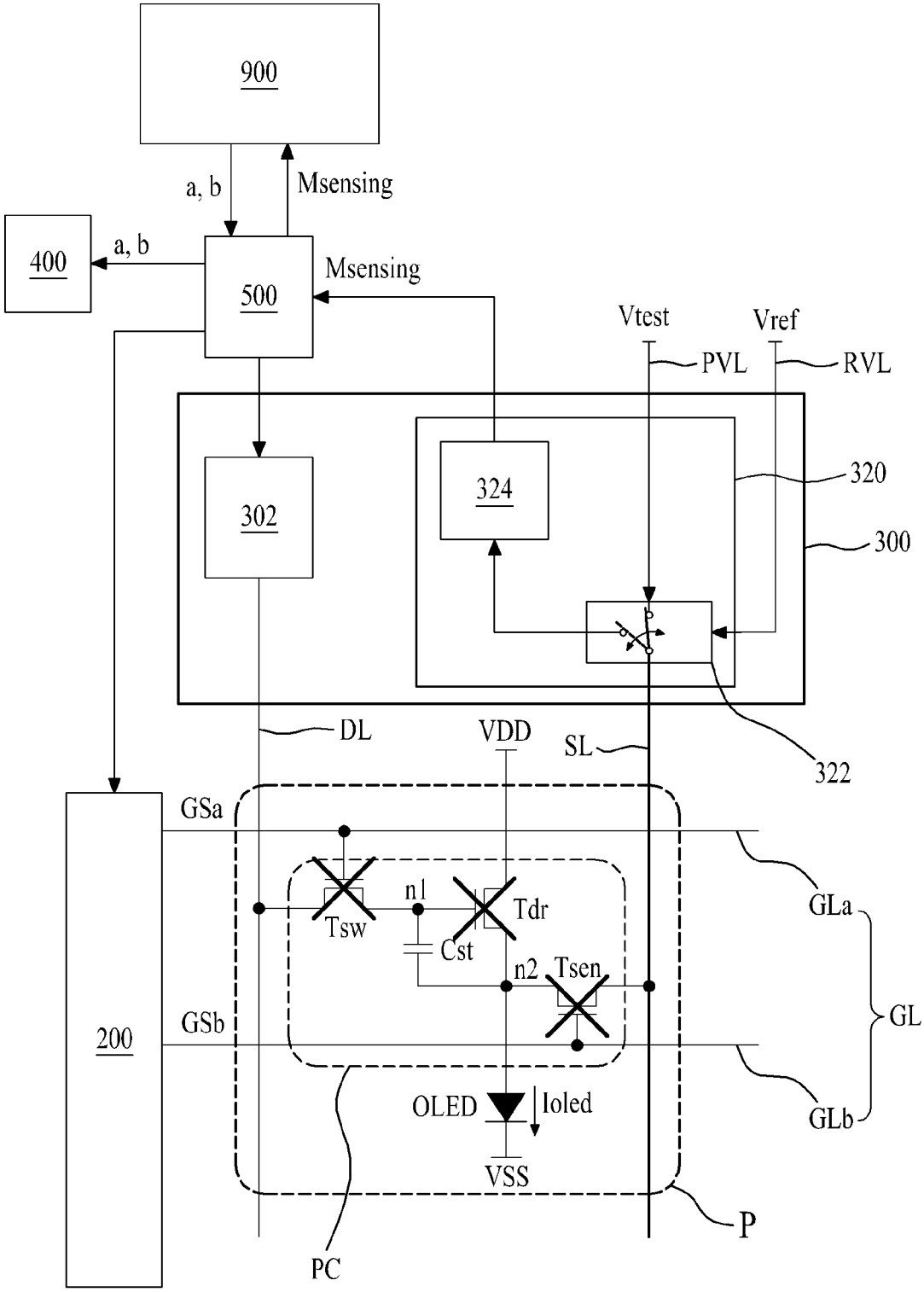
FIG. 8 is a diagram for describing a circuit operation and an operation of calculating a gain error and an offset error in an ADC deviation correction mode using the error correction apparatus according to an embodiment of the present invention.

FIG. 8 is a diagram for describing a circuit operation and an operation of calculating a gain error and an offset error in the ADC deviation correction mode using the error correction apparatus according to an embodiment of the present invention.

First, the timing controller 500 controls driving of the gate driver 200 according to a precharging period of the measurement sync signal Msync, thereby allowing the gate signals GSa and GSb having the gate-off voltage level to be supplied to all the gate line groups GLi of the display panel 100. Simultaneously, the timing controller 500 allows the test voltage Vtest corresponding to the voltage setting signal TVS to be supplied to the precharging voltage supply line PVL, and simultaneously controls the switching unit 322 of the sensing unit 320 built into each of the data driving ICs 300 in order for the sensing line SLi to be connected to the precharging voltage supply line PVL, thereby charging the sensing lines SLi with the test voltage Vtest.

Subsequently, the timing controller 500 controls the switching unit 322 of the sensing unit 320 according to a sensing period of the measurement sync signal Msync, thereby connecting the sensing line SLi to the ADC 324. Therefore, each of the ADCs 324 respectively connected to the plurality of sensing lines SLi digital-converts a voltage of a corresponding sensing line SLi to generate measurement data Msensing, and supplies the generated measurement data Msensing to the timing controller 500. The timing controller 500 supplies the measurement data Msensing to the error calculator 930.

Figure 9:
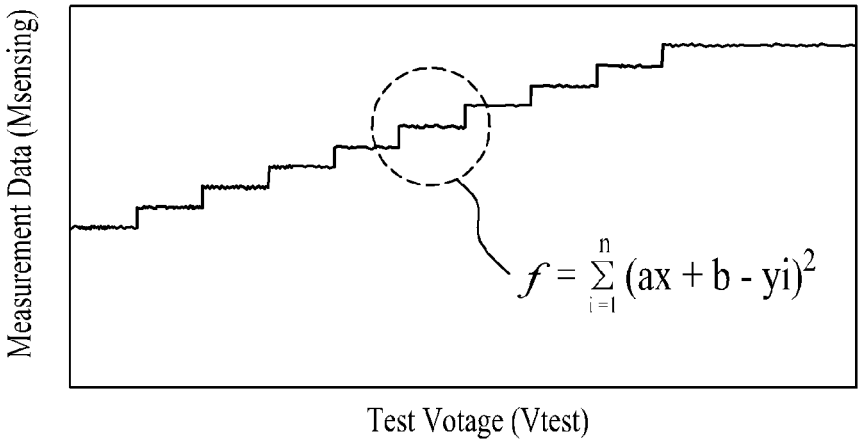
FIG. 9 is a waveform diagram showing measurement data with respect to a test voltage of an ADC of FIG. 8.

Subsequently, the timing controller 500 repeatedly performs the above-described operation by period based on a voltage level while incrementally increasing a level of the test voltage Vtest according to the voltage setting signal TVS, and thus, as shown in FIG. 9, the timing controller 500 supplies the measurement data Msensing based on the level of the test voltage Vtest to the error calculator 930.

Subsequently, the error calculator 930 calculates the gain error "a" and the offset error "b" from a sample regression line "y=ax+b" between X and Y according to a degree of scattering of the measurement data Msensing, by using the least square method based on the measurement data Msensing based on the level of the test voltage Vtest.

In detail, when the sample regression line based on the level of the test voltage Vtest based on the level of the test voltage Vtest is "y=ax+b", a sum of squares of an error is expressed as the following Equation (2):

$$f = \sum_{i=1}^{n} (ax + b - yi)^2 \tag{2}$$

As expressed in the following Equation (3), the error calculator 930 calculates the gain error "a" and the offset error "b" for which a partial differential value is 0 in the function "f" in Equation (2).

$$f_a = \sum_{i=1}^{n} (2ax_i^2 + 2bx_i - 2x_i y_i),\ f_b = \sum_{i=1}^{n} (2ax_i + 2b - 2y_i) \tag{3}$$

$$f_a = f_b = 0$$

$$\left(\sum_{i=1}^{n} x_i^2\right) a + \left(\sum_{i=1}^{n} x_i\right) b = \sum_{i=1}^{n} x_i y_i$$

$$\left(\sum_{i=1}^{n} x_i\right) a + \sum_{i=1}^{n} b = \sum_{i=1}^{n} y_i$$

$$\begin{pmatrix} \sum_{i=1}^{n} x_i^2 & \sum_{i=1}^{n} x_i \\ \sum_{i=1}^{n} x_i & n \end{pmatrix} \begin{pmatrix} a \\ b \end{pmatrix} = \begin{pmatrix} \sum_{i=1}^{n} x_i y_i \\ \sum_{i=1}^{n} y_i \end{pmatrix}$$

The error calculator 930 averages the measurement data Msensing, which are obtained through repeated measurement, according to the level of the test voltage Vtest, and by substituting the average measurement data into a dependent variable "yi" of the function expressed as Equation (2), the error calculator 930 corrects an error value of the measurement data Msensing which intermittently occurs according to the level of the test voltage Vtest. That is, the error calculator 930 compares current measurement data Msensing with previous measurement data Msensing, and when a difference therebetween deviates from a normal range, the error calculator 930 adds the average measurement data Msensing to corresponding measurement data Msensing. However, when the difference is in the normal range, the error calculator 930 adds measurement data Msensing obtained through addition and previous measurement data Msensing.

Figure 10:
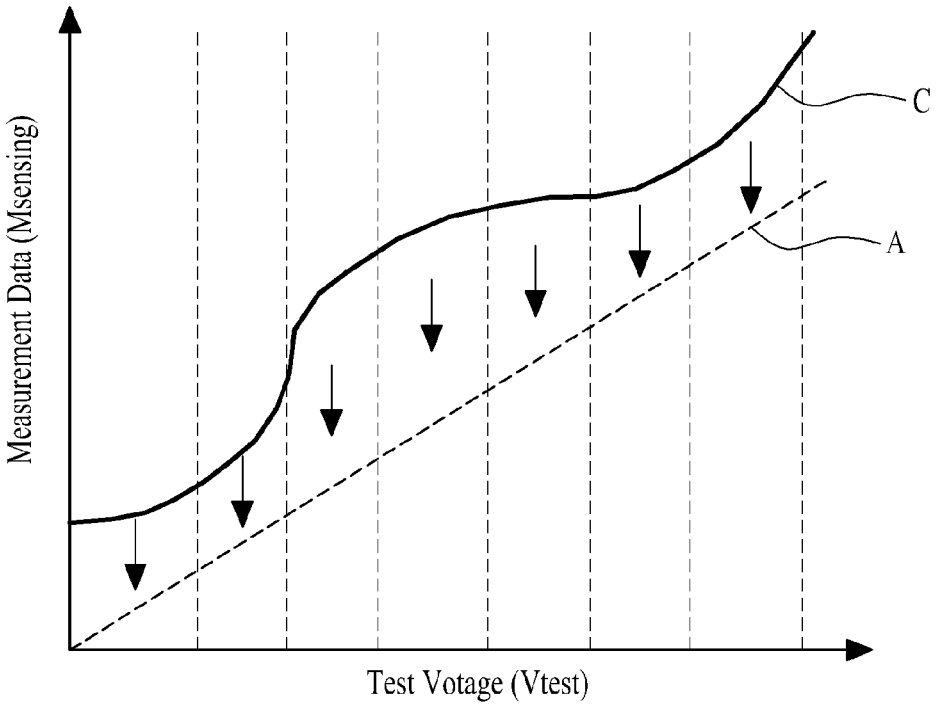
FIGS. 10 and 11 are diagrams for describing an operation of correcting a gain error and an offset error in each section of the test voltage.
Figure 11:
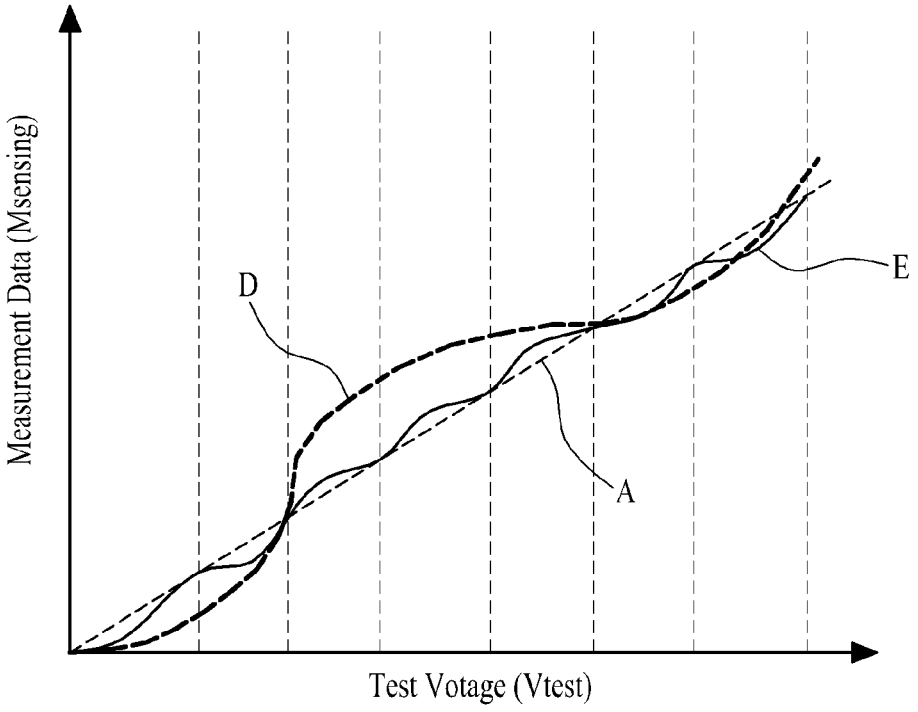

Due to linearity caused by the gain error and offset error of the ADC 324 itself, a correction value for the gain error "a" and the offset error "b" causes distortion to measurement data Msensing requiring ideal correction. In order to prevent the distortion, as shown in a graph C of FIG. 10, the error calculator 930 divides a plurality of sections in which a linearity of the measurement data Msensing based on the level of the test voltage Vtest is maintained, and calculates the gain error "a" and the offset error "b" for each section to correct measurement data Msensing. In the case where the error calculator 930 calculates the gain error "a" and the offset error "b" for each section to correct the measurement data Msensing, the corrected measurement data Msensing value approximates an ideal graph A of FIG. 10 because an error is reduced as in a graph E of FIG. 11 in comparison with a graph D of FIG. 11 in which correction is not performed for each section.

The error calculator 930 may correct the gain error "a" and the offset error "b" between the data driving ICs 300 to calculate the same gain error "a" and offset error "b" of all the ADCs 324, in which case the timing controller 500 applies the same gain error "a" and offset error "b" to sensing data Sdata respectively supplied from the ADCs 324 in a sensing period of a horizontal line to generate corrected sensing data.

The error calculator 930 supplies the gain error "a" and offset error "b" of each ADC 324, which are calculated from a regression line using the least square method, to the timing controller 500. Therefore, the timing controller 500 stores the gain error "a" and the offset error "b", which are supplied by the error calculator 930, in the memory 400, and ends the ADC deviation correction mode. Here, the gain error "a" and offset error "b" of each ADC 324 may be mapped to a lookup table, which may be stored in the memory 400.

Figure 12:
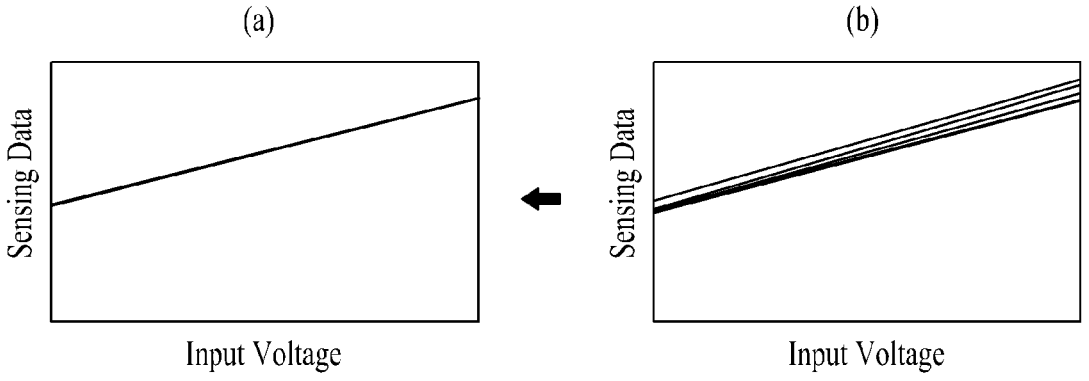
FIG. 12 is diagrams for comparing sensing data before and after applying a gain error and an offset error of each data driving IC according to the present invention.

FIG. 12 is diagrams for comparing sensing data before and after applying a gain error and an offset error of each data driving IC according to the present invention, FIG. 12 (*a*) showing sensing data corrected by applying the gain error and the offset error to the sensing data, and FIG. 12 (*b*) showing sensing data to which the gain error and the offset error are not applied.

As seen in FIG. 12 (*a*), in a case of the sensing data corrected by applying the gain error and the offset error, it can be seen that a deviation between the data driving ICs is reduced.

Figure 13:
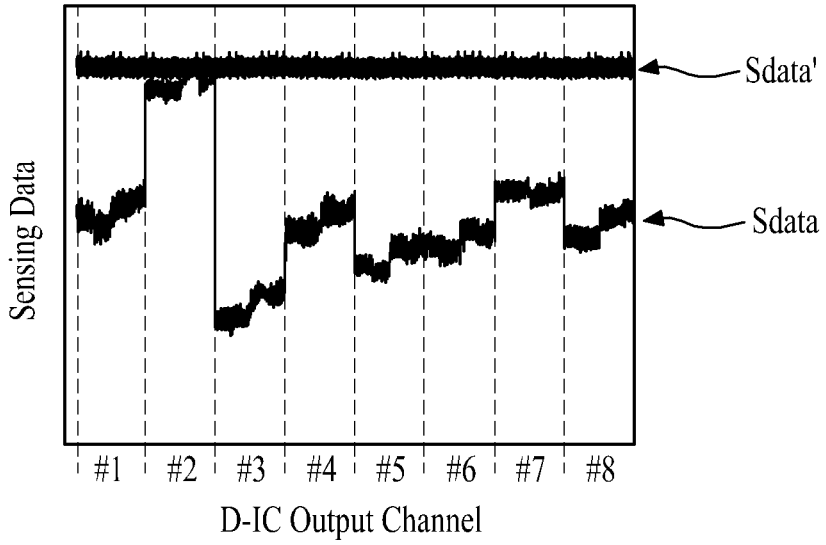
FIG. 13 is a diagram for describing a deviation between sensing data of a plurality of the data driving ICs.

FIG. 13 is a diagram for describing a deviation between sensing data of the plurality of data driving ICs.

As seen in FIG. 13, it can be seen that, in a case of sensing data Sdata output from each of the plurality of data driving ICs, a deviation occurs in each of a plurality of data driving ICs (D-IC #1 to #8) due to the gain error and offset error of the ADC 324, and in a case of sensing data Sdata' corrected by applying the gain error "a" and offset error "b" calculated in the ADC deviation correction mode, a deviation is reduced in each of the plurality of data driving ICs (D-IC #1 to #8).

In the organic light emitting display device according to the embodiments of the present invention, a structure of each pixel P formed in the display panel 100 may be the same pixel structure disclosed in reference documents 1 to 3. In this case, as described above, the organic light emitting display device according to the embodiments of the present invention corrects sensing data corresponding to a characteristic change (sensed by the sensing method disclosed in reference documents 1 to 3) of the driving transistor included in each pixel, thereby solving a problem caused by an output deviation between the ADCs.

As described above, the an organic light emitting display device and a method of driving the same according to the present invention can minimize distortion of sensing data which is caused by the output deviation between the ADCs that respectively sense the characteristic changes of the driving transistors, and can more accurately compensate for the characteristic change of the driving transistor included in each pixel.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel configured to comprise a plurality of pixels that are respectively formed in a plurality of intersection areas between a plurality of gate lines, a plurality of data lines, and a plurality of sensing lines;

a gate driver configured to supply a gate signal to the plurality of gate lines;

a plurality of data driving ICs configured to comprise a data driver, which respectively supplies data voltages to the plurality of data lines, and a sensing unit comprising a plurality of analog-to-digital converters (ADCs) that each sense a characteristic change of a driving transistor, comprised in a corresponding pixel, through a corresponding sensing line to generate sensing data;

a memory configured to store a gain error and an offset error of each of the plurality of ADCs, the gain error and the offset error of each of the plurality of ADCs being calculated based on output data of each ADC when the test voltage is applied to the sensing line; and a timing controller configured to correct the sensing data on a basis of the gain error and the offset error, modulate input data on a basis of the corrected sensing data, and supply the modulated data to the plurality of data driving ICs.

2. The organic light emitting display device of claim 1, wherein the timing controller subtracts the offset error from the sensing data, and divides the subtracted result value by the gain error to calculate the corrected sensing data.

3. The organic light emitting display device of claim 1, wherein, the timing controller separately drives the sensing unit in a precharging period and a sensing period during an ADC deviation correction mode, during the precharging period, the sensing unit supplies a test voltage to the plurality of sensing lines, and during the sensing period, the sensing unit supplies measurement data, output from each of the plurality of ADCs, to the timing controller.

4. The organic light emitting display device of claim 3, wherein the timing controller incrementally increases a voltage level of the test voltage, obtains measurement data, based on the voltage level, output from each of the ADCs to supply the obtained measurement data to an external error correction apparatus, and stores the gain error and the offset error, which are supplied from the error correction apparatus, in the memory.

5. The organic light emitting display device of claim 1, wherein, the sensing unit senses the characteristic change of the driving transistor, comprised in each of a plurality of pixels of a selected horizontal line, through a corresponding sensing line during a display period, and supplies the sensing data corresponding to the characteristic change to the timing controller, and the timing controller corrects the sensing data on a basis of the gain error and the offset error, and modulates input data, which are to be respectively supplied to the pixels of the horizontal line, on a basis of the corrected sensing data.

6. A method of driving an organic light emitting display device, including: a display panel configured to include a plurality of pixels that are respectively formed in a plurality of intersection areas between a plurality of gate lines, a plurality of data lines, and a plurality of sensing lines; and a plurality of data driving ICs including a built-in sensing unit that includes a plurality of analog-to-digital converters (ADCs) selectively connected to the plurality of sensing lines, the method comprising:

(A) calculating a gain error and an offset error of each of the plurality of ADCs on a basis of output data of each ADC based on a test voltage supplied to the plurality of sensing lines;

(B) sensing a characteristic change of a driving transistor, comprised in each of the plurality of pixels, through a corresponding ADC to generate sensing data of each pixel;

(C) correcting the sensing data on a basis of the gain error and the offset error; and (D) modulating input data on a basis of the corrected sensing data to supply the modulated data to the plurality of data driving ICs.

7. The method of claim 6, wherein step (C) comprises subtracting the offset error from the sensing data, and dividing the subtracted result value by the gain error to calculate the corrected sensing data.

8. The method of claim 6, wherein step (A) comprises:

(A1) supplying a gate signal having a gate-off voltage level to the plurality of gate lines;

(A2) supplying the test voltage to the plurality of sensing lines, and sensing, by a corresponding ADC, a voltage of each of the plurality of sensing lines with the test voltage supplied thereto;

(A3) obtaining measurement data, based on the data voltage, output from each of the ADCs; and (A4) calculating a gain error and an offset error of each ADC by using a least square method based on the measurement data to store the gain error and the offset error in a memory.

9. The method of claim 8, wherein, step (A2) comprises incrementally increasing a voltage level of the test voltage, and sensing, by the corresponding ADC, the voltage of each of the plurality of sensing lines with the incrementally increased test voltage supplied thereto, and step (A4) comprises calculating the gain error and the offset error in each section of the test voltage.

10. The method of claim 8, wherein, step (A4) comprises calculating the same gain error and offset error of the plurality of ADCs, and step (C) comprises applying the same gain error and offset error to the sensing data of the plurality of ADCs.

* * * * *